US005223317A

United States Patent [19]

Corbin et al.

[11] Patent Number: 5,223,317

[45] Date of Patent: * Jun. 29, 1993

[54] TEXTURE CARPETS AND RUGS MADE FROM FIBER BLENDS

[75] Inventors: James A. Corbin, Spartanburg; Allen J. Hopkins, Greenville, both of S.C.; Michael C. Whited, Huntersville, N.C.

[73] Assignee: Hoechst Celanese Corporation, Somerville, N.J.

[ * ] Notice: The portion of the term of this patent subsequent to Apr. 7, 2009 has been disclaimed.

[21] Appl. No.: 814,136

[22] Filed: Dec. 30, 1991

Related U.S. Application Data

[63] Continuation-in-part of Ser. No. 577,855, Sep. 5, 1990, Pat. No. 5,102,713.

[51] Int. Cl.[5] ..... B32B 3/02; D02G 3/00

[52] U.S. Cl. ..... 428/92; 428/97; 428/359; 428/362; 428/369; 428/370

[58] Field of Search ..... 428/359, 362, 369, 370, 428/92, 97

[56] References Cited

U.S. PATENT DOCUMENTS 4,248,934 2/1981 Wandel et al. ..... 428/374
4,320,167 3/1986 Wishman ..... 428/288
4,755,336 7/1988 Deeg et al. ..... 264/103
4,839,211 6/1989 Wilkie et al. ..... 428/97 X
4,882,222 11/1989 Talley, Jr. et al. ..... 428/97 X
5,102,713 4/1992 Corbin et al. ..... 428/92

FOREIGN PATENT DOCUMENTS 7825232 11/1978 Fed. Rep. of Germany .

OTHER PUBLICATIONS

"Polyester Filaments Offer New Products for Carpets"; Chemiefasern/Textile Industrie, Mar. 1978, E51-E52.

*Primary Examiner*—George F. Lesmes
*Assistant Examiner*—Terrel Morris
*Attorney, Agent, or Firm*—Philip P. McCann

[57] ABSTRACT

A blend of low shrinkage polyester fibers and high shrinkage polyester fibers is described. In particular, the blend includes high shrinkage PET copolymers having boiling water shrinkages from 6 to 11 percent and low shrinkage PET copolymer fibers having a shrinkage of less than 3 percent. Textured carpets and rugs made from the blend consistently have better initial tuft end point definition and, in most cases, better bulk than corresponding polyester carpets made from conventional polyester fibers.

2 Claims, No Drawings

TEXTURE CARPETS AND RUGS MADE FROM FIBER BLENDS

This application is a continuation-in-part of U.S. Pat. application No. 07/577,855 filed Sept. 5, 1990, now U.S. Pat. No. 5,102,713.

BACKGROUND OF THE INVENTION

The present invention relates to polyester carpets and rugs made from polyester fibers using a specific blend of fibers. It has been found that the specific blend of fibers not only improves the initial tip definition characteristics of the carpet but also increases the bulk of the carpet. In particular, the blend of fibers comprises high shrinkage copolyester fibers and low shrinkage copolyester fibers, the high shrinkage fibers having boiling water shrinkage between about 6 and 11 percent and the low shrinkage fibers having a boiling water shrinkage of less than 3 percent. The copolyester used in the fibers is a copolymer of poly(ethylene terephthalate) and a second component selected from the group polyethylene glycol, diethylene glycol and isophthalic acid. The blend of fibers generally range from 70:30 to 30:70 of the high shrinkage to low shrinkage fibers.

One type of carpet used in residential and commercial establishments is the type known as textured carpet which normally is a cut-pile carpet having twisted, evenly-sheared, medium length pile yarn, the yarn being in the form of individual short lengths of plied yarn (tufts) which has been crimped before heat setting. Each tuft projects upwardly and terminates as a cut end. Yarn generally used in the textured carpet may be nylon, acrylic, polypropylene or polyester. The present invention is directed to the area of textured carpets containing polyester fibers. Also, this invention is directed to rugs made with specific blends of fibers disclosed herein.

The appearance of polyester textured carpet or rug is dependent on the properties of the fibers. For example, the crimp in the individual fibers imparts required cover and loftiness (i.e. firmness, resilience and body) to the carpet while the ply twist of the fibers about each other in the individual tufts gives the carpet a uniform and crisp appearance (i.e. tuft end point definition). The term tuft end point definition is used to describe the crisp appearance of the textured carpet or rug. It is measured qualitatively by a number of individuals reviewing the carpet or rug. Ply twist as used herein refers to the twisting together of two or more single yarns (fibers) to form a ply yarn. The plied yarns serve to support each other. In addition, when the ply yarn is cut or sheared, it is desirous that the single yarns remain tightly together.

An important feature in the commercialization of the textured carpets or rugs is the initial crisp appearance that customers see. However, the initial crisp appearance of textured carpets or rugs made from conventional polyesters can be further improved by enhancing the tuft and point definition. Without good tuft definition, the tuft ends appear as if they are bloomed and visually lose the end point definition and become intermingled with the neighboring tuft ends which gives the carpet a less than desirable crisp appearance.

Efforts in the past to improve the initial tuft end point definition characteristics of polyester saxony carpet have not fully resolved the problem to the satisfaction of the carpet industry. For example, efforts have been made to increase the bulk of the carpet but at the expense of crisp appearance. Generally, when bulk is increased, the tufts are made larger which generally results in loss of end point definition.

Several approaches to improving the tuft end definition point, and, in particular, to improving the initial tuft end point definition, have been disclosed in the prior art. U.S. Pat. Nos. 4,882,222 and 4,839,211 to Wilkie et al disclose a blend of fibers useful for making carpet having better appearance retention characteristics made from a blend of fibers comprising low shrinkage fibers having a boiling water shrinkage of less than 12% and high shrinkage fibers being fibers having boiling water shrinkages of at least 12%. The point of the invention in Wilkie et al is directed to improving the appearance retention characteristics of the carpet made therefrom. Numerous statements within the Wilkie et al patents detract from the point of the present invention. Particularly, it is stated that if the blend contains more than 40% by weight of high shrinkage fibers, the carpet tends to lose its pleasing initial appearance. This is contrary to the findings of the present invention.

The claims of Federal Republic of Germany Utility Model GM 78 25 232 discloses a pile yarn made from 50–80 percent by weight of polybutylene terephthalate fibers having boiling water shrinkage of less than 5 percent and from 20 to 50 percent by weight of polyester fibers having boiling water shrinkages from 6–25 percent. Claim 1 states that the polybutylene terephthalate fiber is not limiting but further comprises polyamide, polyacrylonitrile or polypropylene fibers.

Improvements directed to tuft end point definition of polyester fibers are a continuing objective of the polyester carpet industry to meet the needs of the consumer. There remains a need to develop a polyester carpet and rug having both good tuft end point definition and good bulk so the overall carpet and rug is more pleasing to the consumer.

SUMMARY OF THE INVENTION

The foregoing and other objects are achieved by textured carpets and rugs containing the blend of polyester fibers of the present invention. In particular, the textured carpet or rug contains twisted, evenly sheared, crimped, heat set pile yarn which is a blend of high shrinkage fibers and low shrinkage fibers. The high shrinkage fibers are made from a copolymer of poly(ethylene terephthalate) (PET) and a component selected from the group consisting essentially of polyethylene glycol (PEG), diethylene glycol and isophthalic acid, and have shrinkages between about 6 and 11 percent wherein the fibers are crimped having a crimp frequency from about 6 to 13 crimps per inch and have deniers between about 5 and 20 dpf, while the low shrinkage fibers are also made from a copolymer of poly(ethylene terephthalate) (PET) and a component selected from the group consisting essentially of polyethylene glycol (PEG), diethylene glycol and isophthalic acid, wherein the fibers are crimped with the crimp frequency of from about 6 to 13 crimps per inch and have deniers between about 5 and 20 dpf and have shrinkages of less than 3 percent. Such blends of carpet fibers are used to make saxony carpets.

The blend of fibers in the textured carpets and rugs of the present invention have been found to have improved initial tuft end point definition and bulk as compared to polyester textured carpets and rugs of the prior art.

DESCRIPTION OF THE PREFERRED EMBODIMENTS

The fiber blends of the present invention comprise low shrinkage copolyester fibers and high shrinkage copolyester fibers. (The term "fibers", as used herein, means individual staple fibers or continuous filaments.) Such fiber blends are used, for example, in textured carpet and rugs. The textured carpets and rugs of the present invention may be made in conventional manner using instead of conventional fibers a blend of the fibers comprising the low shrinkage copolyester fibers and high shrinkage copolyester fibers of the present invention. That is, the blend of fibers is processed into pile yarn which is crimped, heat set, tufted into a primary backing and sheared (cut) to provide textured carpet or rugs of the present invention.

The low shrinkage copolyester fibers are crimped fibers having deniers from about 0.5 to about 20 dpf and a shrinkage of less than 3 percent based on the boiling water shrinkage test. The copolyester is a copolymer of polyethylene terephthalate and diethylene glycol, or isophthalic acid, or polyethylene glycol. Preferably, the low shrinkage polyester fibers have shrinkages of less than 2 percent and most preferably, less than 1 percent and deniers between about 5 and 20; and a crimp frequency of about 10 crimps per inch.

The high shrinkage polyester fibers of the fiber blends have shrinkages between about 6 and about 11 percent based on the boiling water shrinkage test. The high shrinkage polyester fibers are crimped having a crimp frequency from about 6 to 13 crimps per inch. The denier of the high shrinkage fibers may be the same as or different from the denier of the low shrinkage fibers of the blend. Suitable fibers which are available in the requisite shrinkage range include, fibers of copolymers of polyethylene terephthalate and a component selected from the group consisting of diethylene glycol, isophthalic acid, or polyethylene glycol.

Preferably, the fiber blend consists of staple fibers because blends of staple fibers, as compared to blends of continuous filaments are easier to make and offer greater flexibility with respect to varying the proportion of the lower shrinkage fibers and the high shrinkage fibers, intimate blending thereof and incorporation of additional fiber components.

Usually staple fibers for use in textured carpets are cut to a definite length, i.e. a length between 6 and 9 inches (15 to 23 centimeters) from a total of substantially identical filaments to provide staple fibers which are of the same composition and have the same denier crimp frequency, cross-sectional shape and length. If desired, low shrinkage fibers of the blend may consist of a mixture of low shrinkage staple fibers having, for example, different cross-sectional shapes and/or different deniers and/or different lengths and/or different polymer compositions for the purpose of providing, for example, special dying effects or to improve the economics and/or luster and/or body of the carpet.

The high shrinkage fibers of the staple blend preferably are cut to the same length as the low shrinkage fibers. The blend of the low shrinkage fibers and the high shrinkage fibers are tested with respect to the initial tuft end point definition and bulk, as well as the tuft end point definitions after traffics. Typically, the weight ratio of the low shrinkage fibers to the high shrinkage fibers present in the blend will be in the range of 30:70 to 70:30 and preferably about 50:50.

The blend may contain in addition to low shrinkage fibers and high shrinkage fibers other fibers so long as the blend provides the above-mentioned appearance of the initial tuft end point definition. For example, the blend may contain fibers made from wool, nylon, etc. or fibers that contain additives such as carbon black, pigments or dyes. It is also contemplated that all or a portion of the fibers of the blends may be treated with materials such as fluorocarbons and/or stain blockers for the purpose of improving soil and stain resistance of the fibers.

The low shrinkage and high shrinkage fibers useful for providing the blends of the present invention may be prepared by conventional techniques of preparing polyester fibers. In particular, the high shrinkage fibers may be made by known technology selected to provide the desired shrinkages. The shrinkages can be obtained by varying the heat setting conditions of the fibers during the processing thereof, as is well known in the art.

The polymer composition of the fibers of the blend is selected to permit processing of the fibers into yarns and carpets, bearing in mind, temperatures, stresses, etc. generally encountered.

In the case of continuous filament blends, the blend can be formed by first steam jet texturing a yarn consisting of the low shrinkage filaments and then inserting high shrinkage filaments into the yarn (e.g. by means of air tangling jet) and, finally, winding the resulting yarn consisting of the fiber blend on a bobbin. In using the fiber blends of this invention, the shrinkage of the high shrinkage fibers are preserved until the fiber is processed into a spun yarn.

The term "shrinkage", as used herein with reference to the fibers is determined by the following test: a sample of the fiber is placed under the tension of 0.100 grams per denier to extend the fiber (straighten out crimp) without stretching or elongating the fiber. The length of the fiber in this condition is measured and recorded at $L_0$. The fiber is then immersed in boiling water for 10 minutes under no tension, removed from the boiling water and allowed to cool and dry for 10 minutes under no tension, and then under a tension of 0.100 grams per denier, its length is again measured. This latter measured length is recorded as $L_1$. Shrinkage is then determined by the following formula: percentage shrinkage equals $(L_{0-L1})/L_{0\times 100}$ or $(L_{0-L1})$ times 100 is equal to shrinkage units.

Textured carpets and rugs are visually tested in a side-by-side comparison with a control carpet without knowledge of which carpet is which and the carpet having the better appearance with respect to initial tuft end point definition and bulk is identified. This test is a simple means for determining which of the carpets has better appearance retention characteristics.

EXAMPLE 1

This example illustrates preparation of textured carpets from low shrinkage fiber/high shrinkage fiber blends of the present invention.

The carpets made from the low shrinkage/high shrinkage fiber blend of the present invention contained a polyester fiber made from a polyester copolymer containing 7.25% by weight of DMT polyethylene glycol. Each of the fibers had a length of 7.5 inches, a denier of about 15 dpf, and an average of 10.5 crimps per inch.

The high shrinkage fiber had a boiling water shrinkage of about 9% and the low shrinkage fiber had a boiling water shrinkage of <1%.

Carpets were prepared from the fibers as follows:

(1) The respective blends of low shrinkage/high shrinkage fibers are converted on a conventional long staple ring spinning frame to provide a singles yarn having a twist in the Z-direction. Two of the yarns are then twisted together on a ply twister with 3.85 tpi of twist to provide the respective blended test yarn.

(2) The yarns were passed through a stuffer box crimping apparatus. The crimping device gives the yarn a two dimensinal crimp which is then set into the yarn by the subsequent heat setting step resulting in a crimped yarn in the carpet. A Suessan Texturing Unit is used with a flapper setting of 12.5 mm. Additional crimp retention is obtained by injecting steam at 0 to 5 psi.

(3) The yarns are heatset in a conventional manner under conditions that are suitable for the fibers of the yarn and that minimize restriction of the shrinkage of any of the fibers in the yarn.

(4) Carpets of textured construction are made.

EXAMPLE 2

Rugs containing the low shrinkage fiber/high shrinkage fiber blends of the present invention. Such rugs contain polyester fiber made from a copolyester copolymer containing 7.25% by weight of DMT polyethylene glycol. Other settings for such rugs include the following:

| | |
|---|---|
| Yarn Count | 3.00/2 cotton count |
| Single Twist | 3.5 Z |
| Ply Twist | 3.0 S |
| Heat Set Temp | 180° C. |
| Gauge | 3/16 inch |
| Pile Height | ¾ inch |
| Weight | 22 oz. |

The fibers in such rugs can be made cationic dyeable by adding to the polymer 5-sulfo isophthalic acid. The modifier may be added at various levels depending on the desired dye depth with 3.5% based on polymer being preferred. Cationic dyes are used in rugs to provide bright, full colors.

Thus, it is apparent that there has been provided in accordance with the present invention, a blend of fibers comprising high shrinkage fibers and low shrinkage fibers that fully satisfy the objects, aims and advantages as set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations that fall within this sphere and scope of the invention.

What is claimed is:

1. A textured carpet comprising twisted, evenly sheared, heatset pile yarn, said yarn being in the form of individual length of pile yarn, each of which is attached to and projects upwardly from a backing and terminates as a cut end, said pile yarn prior to heat setting thereof being a blend of high shrinkage and low shrinkage fibers, the high shrinkage fibers being fibers made from the copolymer of poly(ethylene terephthalate) and the second component selected from the group consisting of polyethylene gycol, diethylene glycol and isophthalic acid containing from about 2 to about 10 percent by weight of the second component and said high shrinkage fibers having shrinkages between about 6 and 11 percent, a frequency of about 10 crimps per inch and a denier from about 5 dpf to about 20 dpf, and the low shrinkage fibers being made from a copolymer of poly(ethylene terephthalate) and from about 2 to about 10 percent by weight of a second component selected from the group consisting of polyethylene glycol, diethylene glycol and isophthalic acid, said low shrinkage fibers being crimped fibers having a crimp frequency of about 10 crimps per inch, and deniers from about 5 dpf to about 20 dpf and having shrinkage of less than 3 percent.

2. A rug comprising twisted, evenly sheared, heatset pile yarn, said yarn being in the form of individual length of pile yarn, each of which is attached to and projects upwardly from a backing and terminates as a cut end, said pile yarn prior to heat setting thereof being a blend of high shrinkage and low shrinkage fibers, the high shrinkage fibers being fibers made from the copolymer of poly(ethylene terephthalate) and the second component selected from the group consisting of polyethylene glycol, diethylene glycol and isophthalic acid containing from about 2 to about 10 percent by weight of the second component and said high shrinkage fibers having shrinkages between about 6 and 11 percent, a frequency of about 10 crimps per inch and a denier from about 0.5 dpf to about 20 dpf, and the low shrinkage fibers being made from a copolymer of poly(ethylene terephthalate) and from about 2 to about 10 percent by weight of a second component selected from the group consisting of polythylene glycol, diethylene glycol and isophthalic acid, said low shrinkage fibers being crimped fibers having a crimp frequency of about 10 crimps per inch, and from about 5 dpf to about 10 dpf and having shrinkage of less than 3 percent.

* * * * *